US006871425B2

(12) United States Patent
Feller

(10) Patent No.: US 6,871,425 B2
(45) Date of Patent: Mar. 29, 2005

(54) WING PLOW APPARATUS FOR ATTACHMENT TO A VEHICLE FOR CARRYING OUT A BENCHING OPERATION

(75) Inventor: Richard L. Feller, Monroe, WI (US)

(73) Assignee: Monroe Truck Equipment Inc., Monroe, WI (US)

( * ) Notice: Subject to any disclaimer, the term of this patent is extended or adjusted under 35 U.S.C. 154(b) by 3 days.

(21) Appl. No.: 10/123,611

(22) Filed: Apr. 16, 2002

(65) Prior Publication Data

US 2003/0192207 A1 Oct. 16, 2003

(51) Int. Cl.[7] ..... E01H 5/04
(52) U.S. Cl. ..... 37/283; 37/236
(58) Field of Search ..... 37/281, 104, 105, 37/236; 404/96; 172/815

(56) References Cited

U.S. PATENT DOCUMENTS 2,101,666 A * 12/1937 Austin ..... 37/236
2,144,698 A * 1/1939 Allan ..... 37/236
2,193,532 A * 3/1940 Frink ..... 37/234
2,524,329 A * 10/1950 Richardson ..... 37/236
2,643,470 A * 6/1953 Kaeser ..... 37/105
3,125,818 A * 3/1964 Kraft et al. ..... 37/236
3,659,363 A * 5/1972 Snyder ..... 37/231
3,805,424 A * 4/1974 Renahan ..... 37/236
4,045,892 A * 9/1977 Farrell ..... 37/236
4,096,652 A * 6/1978 Raines et al. ..... 37/231
4,488,492 A * 12/1984 Ganz ..... 104/12
4,596,081 A * 6/1986 DeBilly et al. ..... 37/281
5,177,887 A * 1/1993 McGugan et al. ..... 37/236
6,363,631 B1 * 4/2002 Cordingley ..... 37/280

* cited by examiner

*Primary Examiner*—Meredith Petravick
(74) *Attorney, Agent, or Firm*—David J. Archer

(57) ABSTRACT

A wing plow apparatus is disclosed for attachment to a vehicle for carrying out a benching operation. The apparatus includes a moldboard having an inboard and an outboard end and a top edge and a cutting edge. A wing post supports and guides the moldboard between a lower and a benching disposition of the moldboard, the benching disposition being higher than the lower disposition. The wing post includes a cylinder and a piston slidably disposed within the cylinder. A connecting rod has a first and a second end, with the first end being secured to the piston. The second end of the connecting rod is rigidly connected to the vehicle. The wing post also includes a further cylinder and a further piston slidably disposed within the further cylinder. A further connecting rod has a first and a second termination. The first termination is secured to the further piston and the second termination is connected to the inboard end of the moldboard. The cylinder and the further cylinder are rigidly secured to each other. The arrangement is such that in operation of the apparatus, when the cylinders are connected to a source of pressurized hydraulic fluid, selective movement of the further connecting rod in a first direction away from the connecting rod and in a second direction towards the connecting rod is permitted.

10 Claims, 5 Drawing Sheets

WING PLOW APPARATUS FOR ATTACHMENT TO A VEHICLE FOR CARRYING OUT A BENCHING OPERATION

BACKGROUND OF THE INVENTION

1. Field of the Invention

The present invention relates to a wing plow apparatus for attachment to a vehicle for carrying out a benching operation.

More specifically, the present invention relates to a wing plow apparatus of reduced height for attachment to a vehicle for carrying out a benching operation.

2. Information Disclosure Statement

Various types of vehicles and earth moving machinery and tractors are required in a road construction operation. Typically, such equipment includes a wing plow. The wing plow is an attachment for a heavy duty vehicle such as a tractor or the like which enables the accurate contouring of a road shoulder or the like. Throughout the specification, the term vehicle is used generically to include but is not limited to a tractor, or a truck chassis whether having a single axle or tandem axles for carrying out a benching operation. Also, the term tractor used herein includes but is not limited to an articulated loader or a motor grader.

The aforementioned wing plow usually includes a moldboard which is adjustably mounted on one side of the vehicle and extends therefrom. Means are provided for controllably lifting the moldboard while maintaining the levelness thereof. Accordingly, as the vehicle moves forwardly, earth is moved and leveled by the cutting edge of the moldboard to accomplish a benching operation.

Typically, a wing plow must be capable of carrying out a benching operation such that the level of the benched earth is 64 inches above the lower disposition of the moldboard. Therefore, in the prior art wing plow, the cylinder would have to have a stroke of 64 inches.

In the prior art wing plow, the mechanism for supporting and raising the moldboard includes a double acting cylinder the top of which, when in the benching disposition reaches a considerable height. Such elevation of the top of the cylinder mechanism in the elevated benching mode limits the ability of the apparatus to pass beneath low clearance bridges or any other overhead obstruction such as power lines or the like.

Also, with the considerable height of the prior art wing plow when in the elevated benching location thereof, the line of vision of the operator thereof is impeded.

The present invention includes two cylinders in which the barrel cavities are connected together relatively in the same plane. While both of the tandem cylinders have a rod of equal stroke, the over all distance to which they can extend or contract is double each of their individual strokes. Therefore, with both barrels having for example a 32 inch stroke, the overall capacity, thus the overall stroke is equal to 64 inches.

Accordingly, with both barrels secured to each other, the overall stroke achieved is 64 inches the same as in the prior art wing plow. However, the top of the cylinder is disposed at a lesser elevation than with the prior art wing plow thus improving visibility and reducing the height clearance requirement of the wing plow.

More, specifically, with the wing plow according to the present invention, the complete extended length movement of the tandem cylinder arrangement is twice the travel length movement of the individual barrels. Thus for example, two 10 inch tandem barrels will have a capability of 20 inches overall travel.

Therefore, it is a primary objective of the present invention to provide an improved wing plow apparatus which overcomes the aforementioned disadvantages of the prior art machines and which makes a considerable contribution to the art of road construction.

Another feature of the present invention is the provision of a wing plow apparatus which has a lower clearance requirement.

A further feature of the present invention is the provision of a wing plow apparatus which reduces the obstruction to vision occasioned by the wing plow.

Also, a further feature of the present invention is that when operated, nothing protrudes out of the wing post above and beyond what extends from the wing post in the lowered location thereof.

Other objects and advantages of the present invention will be apparent to those skilled in the art by a consideration of the detailed description contained hereinafter taken in conjunction with the annexed drawings.

SUMMARY OF THE INVENTION

The present invention relates to a wing plow apparatus for attachment to a vehicle for carrying out a benching operation. The apparatus includes a moldboard having an inboard and an outboard end and a top edge and a cutting edge.

A wing post supports and guides the moldboard between a lower and a benching disposition of the moldboard, the benching disposition being higher than the lower disposition.

The wing post includes a cylinder and a piston slidably disposed within the cylinder. A connecting rod has a first and a second end, with the first end being secured to the piston. The second end of the connecting rod is rigidly connected to the vehicle. The wing post also includes a further cylinder and a further piston slidably disposed within the further cylinder. A further connecting rod has a first and a second termination. The first termination is secured to the further piston and the second termination is connected to the inboard end of the moldboard. The cylinder and the further cylinder are rigidly secured to each other. The arrangement is such that in operation of the apparatus, when the cylinders are connected to a source of pressurized hydraulic fluid, selective movement of the further connecting rod in a first direction away from the connecting rod and in a second direction towards the connecting rod is permitted.

In a more specific embodiment of the present invention, the moldboard defines an inwardly curved forward surface.

Additionally, the wing post further includes a housing having a first and second extremity, the housing being rigidly secured to the vehicle, the housing defining a channel which extends between the extremities of the housing.

The channel is disposed adjacent to the moldboard, the arrangement being such that when the moldboard moves between the lower and the benching dispositions thereof, movement of the inboard end of the moldboard and the second termination of the further connecting rod connected thereto is permitted.

Also, the second end of the connecting rod is rigidly secured to the first extremity of the housing.

Furthermore, the cylinder has a first and a second end, the second end of the cylinder defining an orifice.

A conduit hydraulically connects the orifice to the further cylinder. Additionally, the connecting rod further includes an inner and an outer tube, the tubes being disposed concentrically relative to each other, the tubes extending between the first and second ends of the connecting rod.

The inner tube adjacent to the second end of the connecting rod, defines a port which is selectively connected to the source of pressurized hydraulic fluid.

The inner tube adjacent to the first end of the connecting rod defines an opening which extends through the piston.

Also, the cylinder has a first and a second end, the cylinder defining a cavity for the slidable reception therein of the piston.

The cavity has a first variable sized chamber extending between the first end of the cylinder and the piston.

Furthermore, the cavity also has a second variable sized chamber extending between the second end of the cylinder and the piston. The arrangement is such that when the port is connected to the source of pressurized hydraulic fluid, fluid flows through the port through the inner tube and the opening into the first chamber so that the cylinder is moved in the first direction relative to the piston and the connecting rod.

The second end of the connecting rod defines a further port which is in fluid communication with the outer tube.

The outer tube defines a bore disposed adjacent to the first end of the connecting rod. The arrangement is such that when the cylinder moves in the first direction, hydraulic fluid disposed within the second variable sized chamber flows through the bore into the outer tube and through the further port.

Moreover, the apparatus includes control means for selectively connecting the further port to the source of hydraulic pressure and to a reservoir respectively, the arrangement being such that when the hydraulic fluid is being displaced from the second chamber through the bore into the outer tube, such fluid is drained through the further port.

Also, the further cylinder has a first and a second end, the first end defining a further orifice which is in fluid communication with the conduit.

The further cylinder defines a further cavity which includes a third variable sized chamber which extends between the first end of the further cylinder and the further piston.

A fourth variable sized chamber extends between the second end of the further cylinder and the further piston.

Additionally, a further conduit extends between the first and fourth chambers for permitting a flow therethrough of the hydraulic fluid.

The control means selectively connects the port between the source of pressurized hydraulic fluid and the reservoir respectively. The arrangement is such that in operation of the apparatus, in order to move the moldboard from the benching disposition to the lower disposition, the control means connects the port to the source of pressurized hydraulic fluid. The control means also connects the further port to the reservoir so that the fluid flows from the port into the first variable sized chamber for moving the cylinder in the first direction. Also, the fluid within the second variable sized chamber is displaced through the further port. Additionally, the fluid flowing through the first chamber through the further conduit into the fourth chamber moves the further piston and further connecting rod in the first direction. Furthermore, the fluid within the third chamber is displaced through the conduit into the second chamber for drainage thereof through the further port to the reservoir.

When the control means selectively connects the port to the reservoir and simultaneously connects the further port to the pressurized source for raising the moldboard from the lower disposition to the benching disposition thereof, the fluid flows through the further port into the second chamber for moving the cylinder in the second direction. The fluid further flows through the conduit from the second chamber into the third chamber for moving the further piston and further connecting in the second direction. The fluid within the fourth chamber is displaced through the further conduit into the first chamber for drainage thereof through the port to the reservoir.

As will be appreciated by those skilled in the art, the wing plow according to the present invention is able to almost double the overall travel of the wing slide mechanism when compared with a conventional double acting single cylinder wing plow.

Also, the wing plow according to the present invention requires less storage room when in the collapsed lowered disposition when compared with a conventional single cylinder wing plow. The prior art arrangement with a single cylinder is not nearly as compact when collapsed as the tandem cylinder arrangement of the present invention. Also, the overall travel of the moldboard is less than is the case with the wing plow of the present invention.

Many variations and modifications of the present invention will be readily apparent to those skilled in the art by a consideration of the detailed description contained herein of a preferred embodiment of the present invention taken in conjunction with the annexed drawings. However, such modifications and variations fall within the spirit and scope of the present invention as defined by the appended claims.

Included in such variations and modifications would be an arrangement in which the moldboard is moved between the lowered disposition and the benching disposition thereof by means of a motor connected to a first end of a flexible coupling such as a roller chain. The arrangement is such that when the motor winds the flexible coupling, a second end of the flexible coupling which is secured to the inboard end of the moldboard, raises the moldboard to the benching disposition thereof without any protrusions of the mechanism above the benching disposition. The motor may be a hydraulic motor and the flexible coupling may be arranged so that the flexible coupling is guided over a guide pulley. The arrangement is such that a first portion of the flexible coupling which extends from the motor to the pulley is disposed substantially horizontally while a second portion of the flexible coupling which extends from the pulley to the inboard end of the moldboard is disposed substantially vertically.

In the aforementioned modification, when the motor is actuated, the roller chain or the like moves the moldboard from the lowered disposition to the benching disposition with the pulley remaining no higher than the benching disposition of the moldboard.

BRIEF DESCRIPTION OF THE DRAWINGS

Similar reference characters refer to similar parts throughout the various views and embodiments of the invention.

DETAILED DESCRIPTION OF THE DRAWINGS

Figure 1:
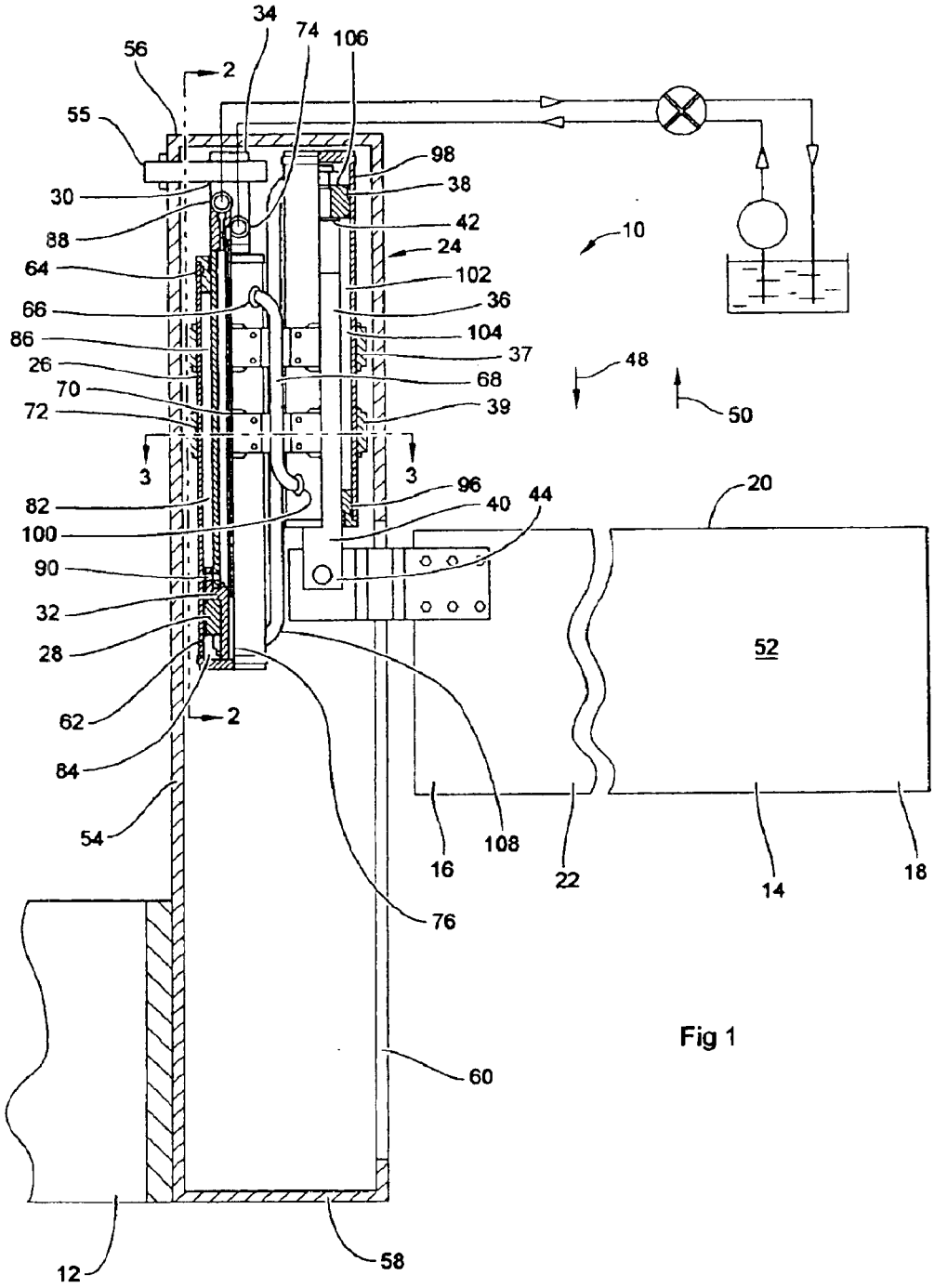
FIG. 1 is an elevational view of a wing plow apparatus according to the present invention disposed in a benching disposition thereof.
Figure 2:
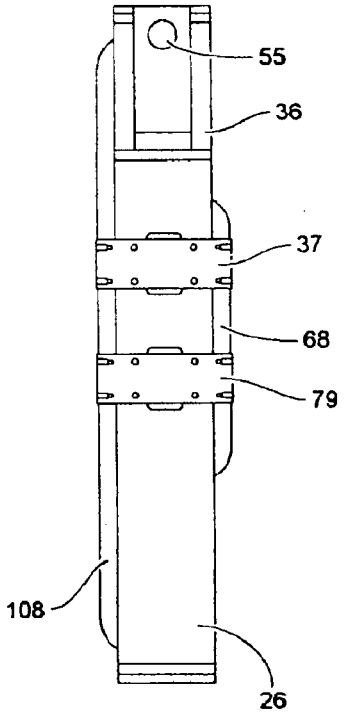
FIG. 2 is a view taken on the line 2—2 of FIG. 1.
Figure 3:
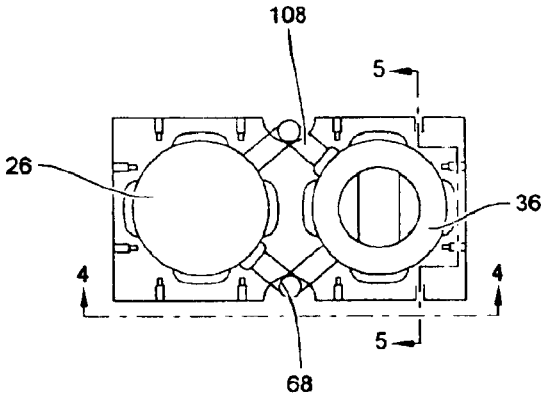
FIG. 3 is a sectional view taken on the line 3—3 of FIG. 1.
Figure 4:
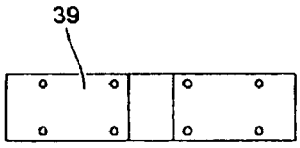
FIG. 4 is a view taken on the line 4—4 of FIG. 3.
Figure 5:
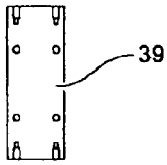
FIG. 5 is a sectional view taken on the line 5—5 of FIG. 3.
Figure 6:
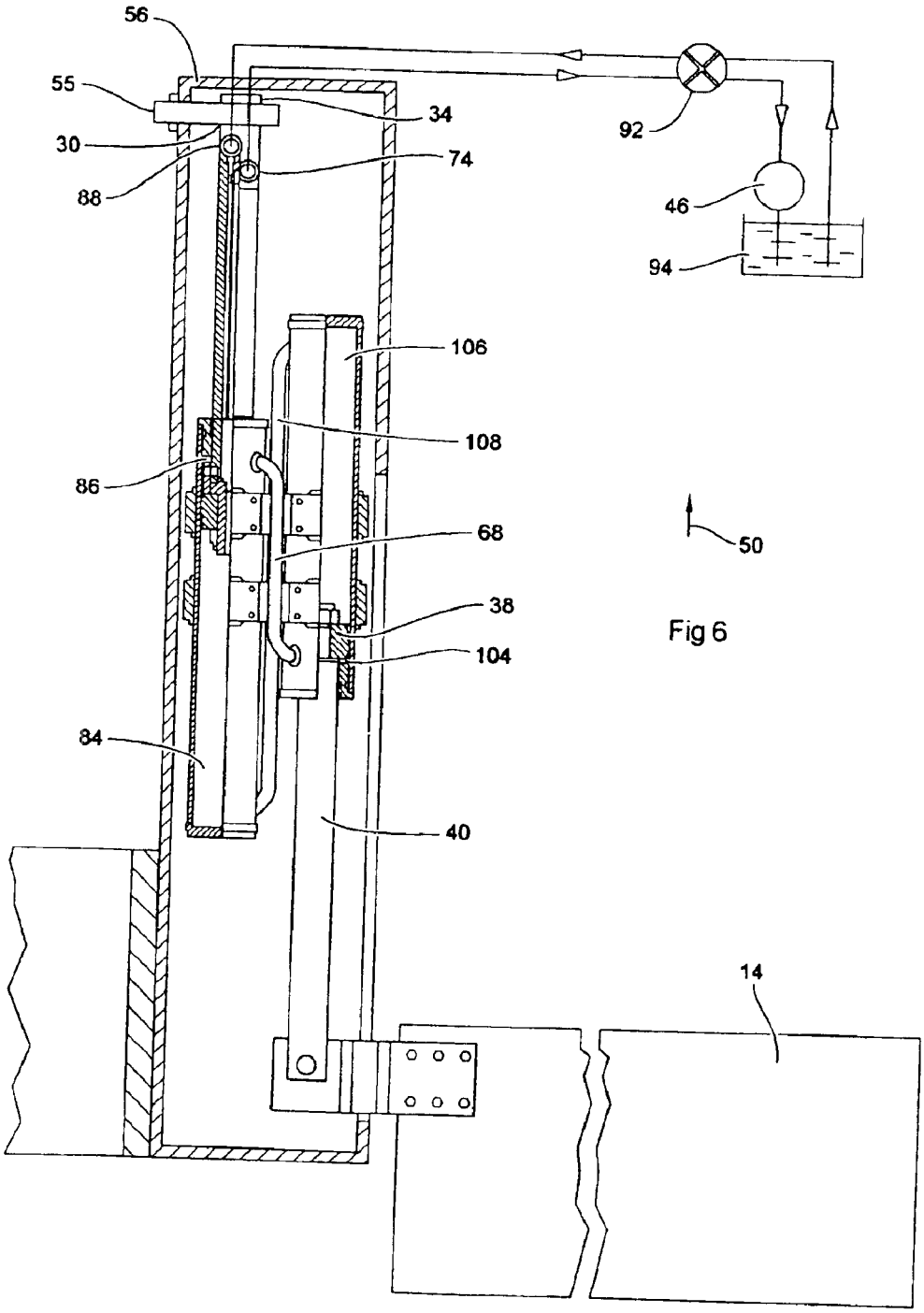
FIG. 6 is a similar view to that shown in FIG. 1 but shows the apparatus in the lower disposition thereof.

FIG. 1 is an elevational view of the wing plow apparatus generally designated 10 according to the present invention. As shown in FIG. 1, the moldboard is disposed in the benching disposition thereof. The wing plow apparatus 10 is attached to a vehicle 12 for carrying out a benching operation. The apparatus 10 includes a moldboard 14 having an inboard and an outboard end 16 and 18 respectively and a top edge 20 and a cutting edge 22. A wing post generally designated 24 supports and guides the moldboard 14 between a benching disposition thereof as shown in FIG. 1 and a lower disposition of the moldboard 14 as shown in FIG. 6. As shown in FIGS. 1 and 6, the benching disposition shown in FIG. 1 is higher than the lower disposition shown in FIG. 6.

The wing post 24 includes a cylinder 26 and a piston 28 slidably disposed within the cylinder 26. A connecting rod 30 has a first and a second end 32 and 34 respectively, with the first end 32 being secured to the piston 28. The second end 34 of the connecting rod 30 is rigidly connected to the vehicle 12. A further cylinder 36 has a further piston 38 slidably disposed therein. A further connecting rod 40 has a first and a second termination 42 and 44 respectively. The first termination 42 is secured to the further piston 38 and the second termination 44 is connected to the inboard end 16 of the moldboard 14 as shown in FIG. 1. The cylinder 26 and the further cylinder 36 are rigidly secured to each other by straps 37 and 39 respectively. The arrangement is such that in operation of the apparatus 10, when the cylinders 26 and 36 are connected to a source 46 of pressurized hydraulic fluid, selective movement of the further connecting rod 40 in a first direction as indicated by the arrow 48 away from the connecting rod 30 and in a second direction as indicated by the arrow 50 towards the connecting rod 30 is permitted.

In a more specific embodiment of the present invention, the moldboard 14 defines an inwardly curved forward surface 52.

Additionally, the wing post 24 further includes a housing 54 having a first and second extremity 56 and 58 respectively, the housing 54 being rigidly secured to the vehicle 12, the housing 54 defining a channel 60 which extends between the extremities 56 and 58 of the housing 54.

The channel 60 is disposed adjacent to the moldboard 14, the arrangement being such that when the moldboard 14 moves between the lower and the benching dispositions thereof, movement of the inboard end 16 of the moldboard 14 and the second termination 44 of the further connecting rod 40 connected thereto is permitted.

Also, the second end 34 of the connecting rod 30 is rigidly secured to the first extremity 56 of the housing 54 by pin 55.

Furthermore, the cylinder 26 has a first and a second end 62 and 64 respectively, the second end 64 of the cylinder 26 defining an orifice 66.

A conduit 68 hydraulically connects the orifice 66 to the further cylinder 36.

Additionally, the connecting rod 30 further includes an inner and an outer tube 70 and 72 respectively, the tubes 70 and 72 being disposed concentrically relative to each other, the tubes 70 and 72 extending between the first and second ends 32 and 34 respectively of the connecting rod 30.

The inner tube 70 adjacent to the second end 34 of the connecting rod 30, defines a port 74 which is selectively connected to the source 46 of pressurized hydraulic fluid.

The inner tube 70 adjacent to the first end 32 of the connecting rod 30 defines an opening 76 which extends through the piston 28.

Also, the cylinder 26 defines a cavity 82 for the slidable reception therein of the piston 28.

The cavity 82 has a first variable sized chamber 84 extending between the first end 62 of the cylinder 26 and the piston 28.

Furthermore, the cavity 82 also has a second variable sized chamber 86 extending between the second end 64 of the cylinder 26 and the piston 28. The arrangement is such that when the port 74 is connected to the source 46 of pressurized hydraulic fluid, fluid flows through the port 74 through the inner tube 70 and the opening 76 into the first chamber 84 so that the cylinder 26 is moved in the first direction 48 relative to the piston 28 and the connecting rod 30.

The second end 34 of the connecting rod 30 defines a further port 88 in fluid communication with the outer tube 72.

The outer tube 72 defines a bore 90 disposed adjacent to the first end 32 of the connecting rod 30. The arrangement is such that when the cylinder 26 moves in the first direction 48, hydraulic fluid disposed within the second variable sized chamber 86 flows through the bore 90 into the outer tube 72 and through the further port 88.

Moreover, the apparatus 10 includes control means 92 for selectively connecting the further port 88 to the source 46 of hydraulic pressure and to a reservoir 94 respectively. The arrangement is such that when the hydraulic fluid is being displaced from the second chamber 86 through the bore 90 into the outer tube 72, such fluid is drained through the further port 88.

Also, the further cylinder 36 has a first and a second end 96 and 98 respectively, the first end 96 defining a further orifice 100 which is in fluid communication with the conduit 68.

The further cylinder 36 defines a further cavity 102 which includes a third variable sized chamber 104 which extends between the first end 96 of the further cylinder 36 and the further piston 38.

A fourth variable sized chamber 106 extends between the second end 98 of the further cylinder 36 and the further piston 38.

Additionally, a further conduit 108 extends between the first and fourth chambers 84 and 106 respectively for permitting a flow therethrough of the hydraulic fluid.

The control means 92 selectively connects the port 74 to the source 46 of pressurized hydraulic fluid and the reservoir 94 respectively. The arrangement is such that in operation of the apparatus 10, in order to move the moldboard 14 from the benching disposition shown in FIG. 1 to the lower disposition shown in FIG. 6, the control means 92 connects the port 74 to the source 46 of pressurized hydraulic fluid. The control means 92 also connects the further port 88 to the reservoir 94 so that the fluid flows from the port 74 into the first variable sized chamber 84 for moving the cylinder 26 in the first direction 48. Also, the fluid within the second variable sized chamber 86 is displaced through the further port 88. Additionally, the fluid flowing through the first chamber 84 through the further conduit 108 into the fourth chamber 106 moves the further piston 38 and further connecting rod 40 in the first direction 48. Furthermore, the fluid within the third chamber 104 is displaced through the conduit 68 into the second chamber 86 for drainage thereof through the further port 88 to the reservoir 94.

As shown in FIG. 6, the control means 92 selectively connects the port 74 to the reservoir 94 and simultaneously connects the further port 88 to the pressurized source 46 such that the moldboard 14 is raised from the lower disposition shown in FIG. 6 to the benching disposition thereof shown in FIG. 1. The fluid flows through the further port 88 into the second chamber 86 for moving the cylinder 26 in the second direction 50. The fluid further flows through the conduit 68 from the second chamber 86 into the third chamber 104 for moving the further piston 38 and further connecting rod 40 in the second direction 50. The fluid within the fourth chamber 106 is displaced through the further conduit 108 into the first chamber 84 for drainage thereof through the port 74 to the reservoir 94.

In a prototype of the subject wing plow, the tandem cylinder wing arrangement included two different cylinder bodies that were pinned to each other and hydraulically plumbed to each other which tended to increase the horizontal width of the wing post. Subsequently, the barrels were modified so that they could be welded to each other dramatically reducing the horizontal width or space required by the tandem cylinder arrangement.

Accordingly, the present invention, by reducing the required height clearance compared with the prior art proposals, provides an apparatus which can be moved through bridges having lower clearances. The apparatus also permits greater visibility to the operator thereof.

Figure 7:
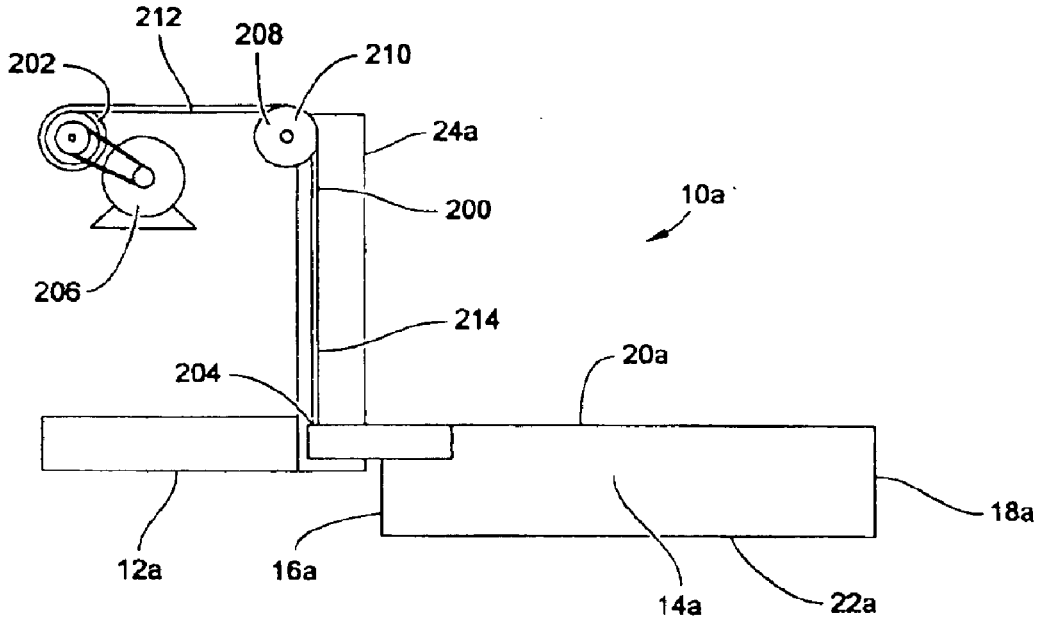
FIG. 7 is a similar view to that shown in FIG. 1 but shows an alternative embodiment of the present invention with a moldboard in the lower disposition thereof.
Figure 8:
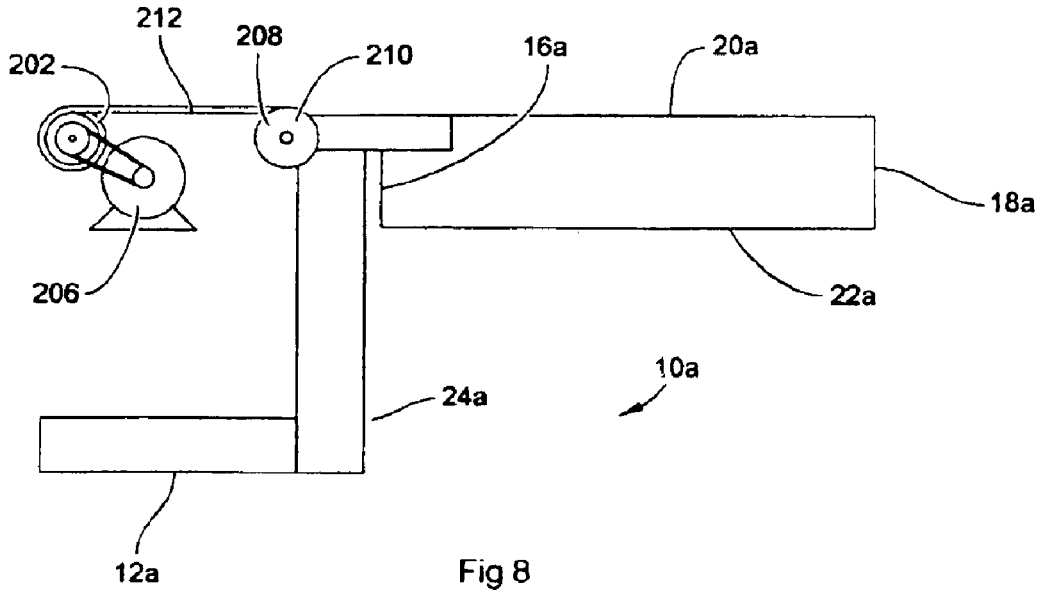
FIG. 8 is a similar view to that shown in FIG. 7 but with the moldboard raised to the benching disposition thereof.

In a modification of the present invention as shown in FIG. 7, a wing plow apparatus 10*a* is shown for attachment to a vehicle 12*a* for carrying out a benching operation. The apparatus 10*a* includes a moldboard 14*a* having an inboard and an outboard end 16*a* and 18*a* respectively and a top edge 20*a* and a cutting edge 22*a*. The apparatus 10*a* also includes a wing post 24*a* for supporting and guiding the moldboard 14*a* between a lower disposition of the moldboard 14*a* as shown in FIG. 7, and a benching disposition of the moldboard 14*a* as shown in FIG. 8, the benching disposition as shown in FIG. 8 being higher than the lower disposition as shown in FIG. 7.

The wing post 24*a* includes a flexible coupling 200 having a first and a second end 202 and 204 respectively, the second end 204 being secured to the inboard end 16*a* of the moldboard 14*a*. A motor 206 is disposed no higher than the benching disposition of the moldboard 14*a*, as shown in FIG. 8. The motor 206 is connected to the first end 202 of the flexible coupling 200. The arrangement is such that in operation of the apparatus 10*a*, when the motor 206 is actuated, the motor 206 winds the flexible coupling 200 so that the second end 204 of the coupling 200 raises the moldboard 14*a* to the benching disposition thereof as shown in FIG. 8.

Preferably, the flexible coupling 200 is a roller chain and the apparatus 10*a* includes a pulley 208 for guiding the flexible coupling 200. An axle 210 is rigidly secured to the vehicle 12*a* for rotatably supporting the pulley 208. The flexible coupling 200 includes a first portion 212 which extends from the motor 206 to the pulley 208 and a second portion 214 which extends from the pulley 208 to the inboard end 16*a* of the moldboard 14*a*. The first portion 212 is disposed substantially horizontally and the second portion 214 is disposed substantially vertically. Also, the motor 206 is a hydraulic motor.

Figure 9:
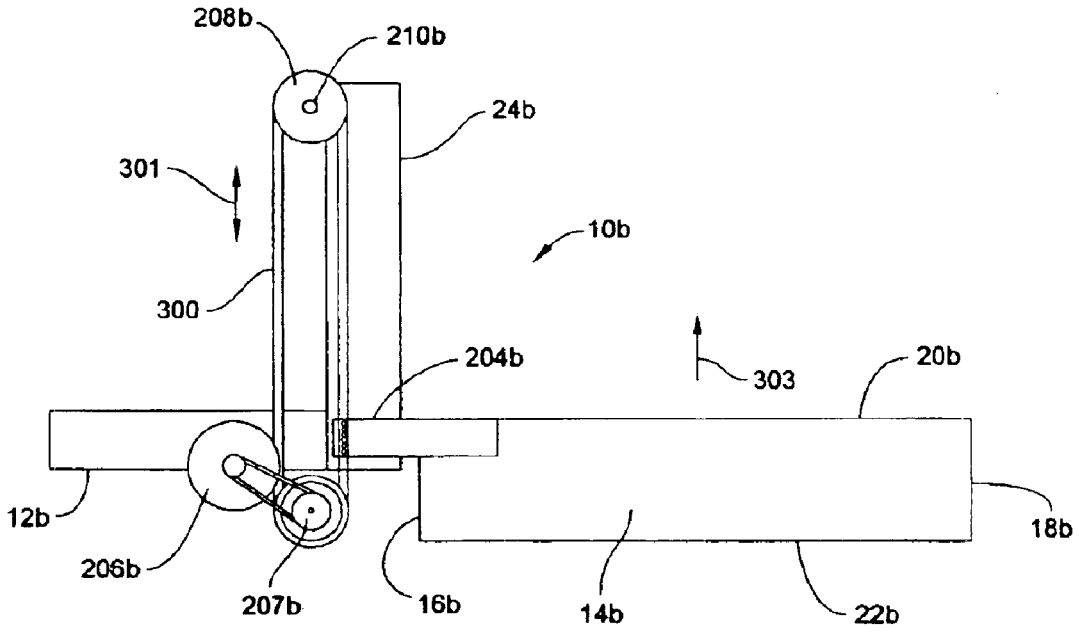
FIG. 9 is a similar view to that shown in FIG. 1 but shows another alternative embodiment of the present invention with a moldboard in the lower disposition thereof.

FIG. 9 is a similar view to that shown in FIG. 1 but shows another alternative embodiment of the present invention with a moldboard 14*b* in the lower disposition thereof. As shown in FIG. 9, a wing plow apparatus 10*b* is shown for attachment to a vehicle 12*b* for carrying out a benching operation. The apparatus 10*b* includes the moldboard 14*b* which has an inboard and an outboard end 16*b* and 18*b* respectively and a top edge 20*b* and a cutting edge 22*b*. The apparatus 10*b* also includes a wing post 24*b* for supporting and guiding the moldboard 14*b* between a lower disposition of the moldboard 14*b* as shown in FIG. 9, and a benching or upper disposition of the moldboard 14*b* as shown in FIG. 10, the benching disposition as shown in FIG. 10 being higher than the lower disposition as shown in FIG. 9.

The wing post 24*b* includes a flexible coupling 300 such as an endless chain. A motor such as a bi-directional hydraulic motor 206*b* is drivingly connected to the chain 300. More specifically, the chain 300 is trained around sprockets 207*b* and 208*b*. The arrangement is such that in operation of the apparatus 10*b*, when the motor 206*b* is actuated, the motor 206*b* via the sprocket 207*b* moves the chain 300 as indicated by the arrow 301 so that the chain 300 raises the moldboard 14*b* to the benching disposition thereof as shown in FIG. 10. or lowers the moldboard 14*b* to the lower disposition shown in FIG. 9 as indicated also by the bi-directional arrow 301.

Preferably, the chain 300 is a roller chain and the apparatus 10*b* includes the sprocket 208*b* which is driven by the chain 300. An axle 210*b* is rigidly secured to the vehicle 12*b* for rotatably supporting the sprocket 208*b*.

Figure 10:
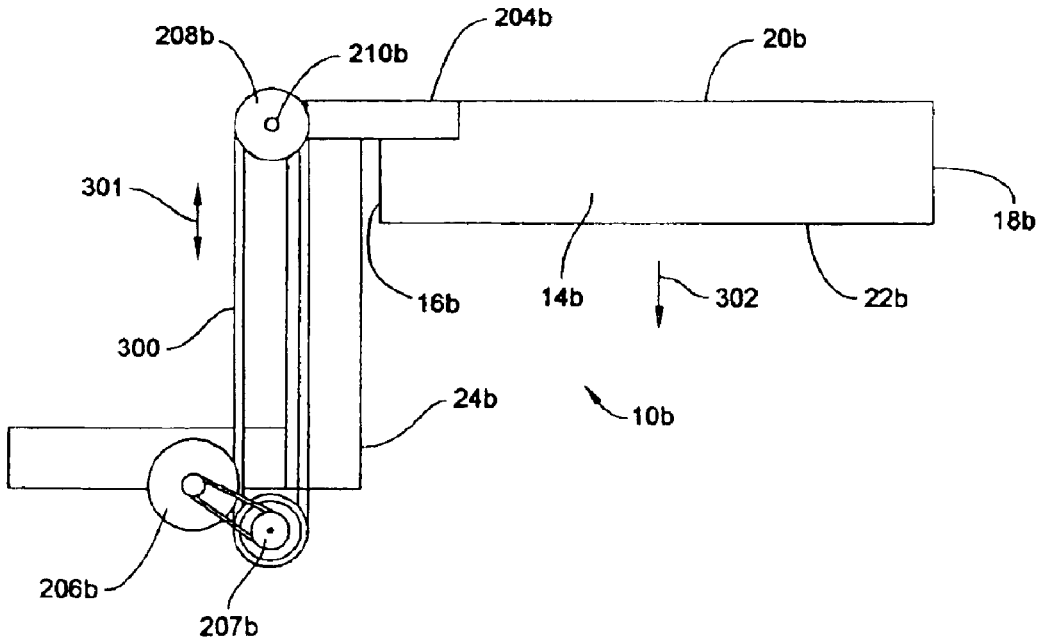
FIG. 10 is a similar view to that shown in FIG. 9 but with the moldboard in the upper disposition thereof.

FIG. 10 is a similar view to that shown in FIG. 9 but with the moldboard 14*b* in the upper disposition thereof. The bi-directional motor 206*b* enables the moldboard 14*b* to be lowered as indicated by the arrow 302 shown in FIG. 10 and raised to the benching disposition as indicated by the arrow 303 shown in FIG. 9.

The present invention provides a unique arrangement for raising a moldboard from a lower to a benching disposition while avoiding the need for any protrusion of the lifting mechanism out of the wing post above the moldboard in the benching disposition thereof.

What is claimed is:

1. A wing plow apparatus for attachment to a vehicle for carrying out a benching operation, the apparatus comprising:

a moldboard having an inboard and an outboard end and a top edge and a cutting edge;

a wing post for supporting and guiding the moldboard between a lower disposition of the moldboard and a benching disposition of the moldboard, the benching disposition being higher than the lower disposition;

the wing post including:

a cylinder;

a piston slidably disposed within the cylinder;

a connecting rod having a first and a second end, the first end being secured to the piston, the second end being rigidly connected to the vehicle;

a further cylinder;

a further piston slidably disposed within the further cylinder;

a further connecting rod having a first and a second termination, the first termination being secured to the further piston, the second termination being connected to the inboard end of the moldboard; and the cylinder and the further cylinder being rigidly secured to each other, the arrangement being such that in operation of the apparatus, when the cylinders are connected to a source of pressurized hydraulic fluid, selective movement of the further connecting rod in a first direction away from the connecting rod and in a second direction towards the connecting rod is permitted.

2. A wing plow apparatus as set forth in claim 1 wherein the moldboard defines an inwardly curved forward surface.

3. A wing plow apparatus as set forth in claim 1 wherein the wing post further includes:

a housing having a first and second extremity, the housing being rigidly secured to the vehicle, the housing defining a channel which extends between the extremities of the housing;

the channel being disposed adjacent to the moldboard, the arrangement being such that when the moldboard moves between the lower and the benching dispositions thereof, movement of the inboard end of the moldboard and the second termination of the further connecting rod connected thereto is permitted.

4. A wing plow apparatus as set forth in claim 3 wherein the second end of the connecting rod is rigidly secured to the first extremity of the housing.

5. A wing plow apparatus as set forth in claim 1 wherein the cylinder has a first and a second end, the second end of the cylinder defining an orifice;

a conduit hydraulically connecting the orifice to the further cylinder.

6. A wing plow apparatus as set forth in claim 5 wherein the connecting rod further includes:

an inner and an outer tube, the tubes being disposed concentrically relative to each other, the tubes extending between the first and second ends of the connecting rod;

the inner tube adjacent to the second end of the connecting rod, defining a port which is selectively connected to the source of pressurized hydraulic fluid;

the inner tube adjacent to the first end of the connecting rod defining an opening which extends through the piston;

the cylinder having a first and a second end, the cylinder defining a cavity for the slidable reception therein of the piston;

the cavity having a first variable sized chamber extending between the first end of the cylinder and the piston;

the cavity also having a second variable sized chamber extending between the second end of the cylinder and the piston, the arrangement being such that when the port is connected to the source of pressurized hydraulic fluid, fluid flows through the port through the inner tube and the opening into the first chamber so that the cylinder is moved in the first direction relative to the piston and the connecting rod.

7. A wing plow apparatus as set forth in claim 6 wherein the second end of the connecting rod defines a further port in fluid communication with the outer tube;

the outer tube defining a bore disposed adjacent to the first end of the connecting rod, the arrangement being such that when the cylinder moves in the first direction, hydraulic fluid disposed within the second variable sized chamber flows through the bore into the outer tube and through the further port.

8. A wing plow apparatus as set forth in claim 7 including:

control means for selectively connecting the further port to the source of hydraulic pressure and to a reservoir respectively, the arrangement being such that when the hydraulic fluid is being displaced from the second chamber through the bore into the outer tube, such fluid is drained through the further port.

9. A wing plow apparatus as set forth in claim 8 wherein the further cylinder has a first and a second end, the first end defining a further orifice which is in fluid communication with the conduit;

the further cylinder defining a further cavity;

the further cavity including:

a third variable sized chamber which extends between the first end of the further cylinder and the further piston;

a fourth variable sized chamber which extends between the second end of the further cylinder and the further piston;

a further conduit extending between the first and fourth chambers for permitting a flow therethrough of the hydraulic fluid;

the control means selectively connecting the port between the source of pressurized hydraulic fluid and the reservoir respectively, the arrangement being such that in operation of the apparatus, in order to move the moldboard from the benching disposition to the lower disposition, the control means connects the port to the source of pressurized hydraulic fluid, the control means also connecting the further port to the reservoir so that the fluid flows from the port into the first variable sized chamber for moving the cylinder in the first direction, the fluid within the second variable sized chamber being displaced through the further port, the fluid flowing through the first chamber through the further conduit into the fourth chamber for moving the further piston and further connecting rod in the first direction, the fluid within the third chamber being displaced through the conduit into the second chamber for drainage thereof through the further port to the reservoir.

10. A wing plow apparatus as set forth in claim 9 wherein the control means selectively connects the port to the reservoir and simultaneously connects the further port to the pressurized source such that the moldboard is raised from the lower disposition to the benching disposition thereof, the fluid flowing through the further port into the second chamber for moving the cylinder in the second direction, the fluid further flowing through the conduit from the second chamber into the third chamber for moving the further piston and further connecting rod in the second direction, the fluid within the fourth chamber being displaced through the further conduit into the first chamber for drainage thereof through the port to the reservoir.

* * * * *